US005123307A

United States Patent [19]

Dyer

[11] Patent Number: 5,123,307

[45] Date of Patent: Jun. 23, 1992

[54] APPARATUS AND METHOD FOR OPENING A LOCKED DOOR

[76] Inventor: Robert L. Dyer, 951-2 Old Country Rd., Ste. 329, Belmont, Calif. 94002

[21] Appl. No.: 671,437

[22] Filed: Mar. 19, 1991

[51] Int. Cl.[5] ..... B25B 33/00

[52] U.S. Cl. ..... 81/15.9

[58] Field of Search ..... 81/15.9, 488, 64, 3.4, 81/177.1; 70/465

[56] References Cited

U.S. PATENT DOCUMENTS 4,683,783 8/1987 Fanberg ..... 81/15.9
4,836,061 6/1989 Weintraub ..... 81/15.9
4,873,897 10/1989 Williams ..... 81/15.9
4,876,927 10/1989 Mullen ..... 81/15.9
4,882,954 11/1989 Selby ..... 81/15.9

*Primary Examiner*—Roscoe V. Parker
*Attorney, Agent, or Firm*—Limbach & Limbach

[57] ABSTRACT

An apparatus and method for manipulating the doorknob of a locked door. An elongated rod is inserted under the door and rotated to a vertical position. A gripper is attached to the rod and engages the doorknob as the rod is rotated. A cord is attached to the gripper, and manipulation of the rod and cord in combination turns the doorknob and opens the locked door.

9 Claims, 3 Drawing Sheets

APPARATUS AND METHOD FOR OPENING A LOCKED DOOR

FIELD OF THE INVENTION

This invention relates generally to an apparatus and method for opening locked doors, and more particularly, to a device which can be inserted under the locked door and manipulated to turn the doorknob to open the lock.

BACKGROUND OF THE INVENTION

It is all too common to find oneself locked out of one's home or office and unable to enter. Several methods are known to gain access through locked doors. For electronic-type locks, commonly known as card key systems, the locksmith drills a hole into the lock case to release the electronic mechanism. However, this causes damage to the unit and often requires replacement of the lock. In similar fashion, standard mechanical cylinder locks can be opened by drilling the cylinder out. This requires inserting and repinning a new cylinder. A third method for pin and tumbler locks is the use of a pick set, wherein the lock is "picked" using a combination of pins. However, pick sets are illegal in most states except when issued to registered locksmiths.

Thus, it would be desirable if there were a device which could open locked doors without the necessity for incurring damage to the door or to the lock, and without the time and expense required to hire a locksmith to pick the lock.

Therefore, it is an object of the present invention to provide a method and apparatus which permits the user to quickly and easily gain access to a locked door.

SUMMARY OF THE INVENTION

A method and apparatus for opening a locked door is presented. In the preferred embodiment, an elongated rod is adapted to be inserted in the narrow space between the floor and the bottom of the door. The rod has a handle end and a gripper end. A handle is disposed at the handle end of the rod. A gripper is disposed at the gripper end of the rod. The gripper comprises a short rigid member disposed substantially perpendicular to the longitudinal axis of the rod, a gripper pad affixed at one edge to the short rigid member, and a cord coupling means attached to the gripper pad at the edge opposite the short rigid member. A cord is attached to the cord coupling means. The cord has a length which is approximately one hundred fifty percent of the length of the elongated rod. Once the elongated rod is inserted under the door, the handle is used to rotate the rod and gripper to engage the doorknob. The handle and cord are then manipulated in combination to turn the doorknob and open the lock.

DETAILED DESCRIPTION OF THE INVENTION

Figure 1:
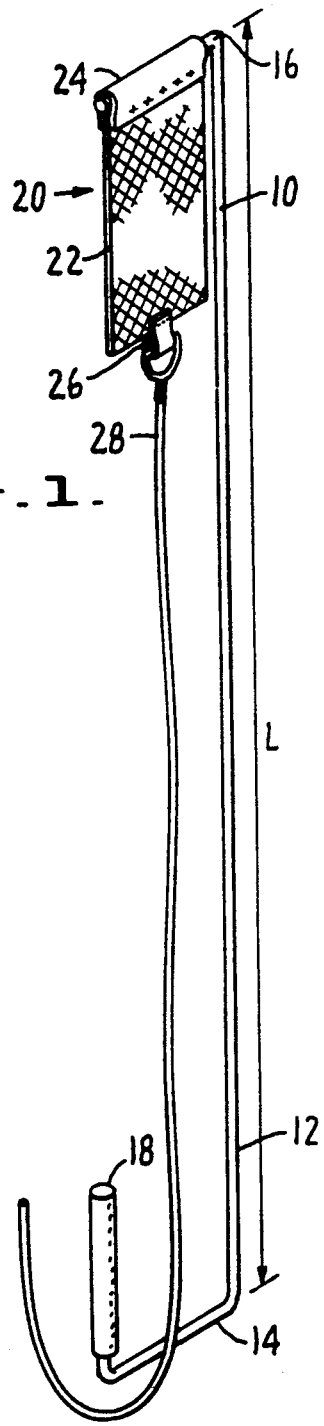
FIG. 1 is a perspective view of a tool according to the present invention.

A method and apparatus for opening a locked door is presented. According to the invention, the user of the apparatus stands outside the locked door and slides a portion of the apparatus under the door. The apparatus must be sufficiently rigid such that the user can then maneuver the apparatus to an upright position perpendicular to the floor and corresponding to the height of the door knob, door handle, or deadbolt on the inside of the door. The user then manipulates the apparatus and causes the knob, handle, or deadbolt to turn, thus unlocking and opening the door. The apparatus will not work, however, on double-cylinder type locks. A particularly preferred embodiment is shown in FIG. 1.

An elongated rod 10, preferably made of one-eighth inch diameter round metal stock, has a main section 12, a handle end 14, and a gripper end 16. The main section 12 has a length L which is selected to correspond to a standard doorknob hardware height, such as forty, forty-four or fifty-six inches. The handle end 14 is perpendicular to main section 12 for approximately five inches and then angled upward toward the gripper end 16. A handle 18 is adapted to fit over the handle end 14 to facilitate gripping and manipulating the tool.

Figure 2:
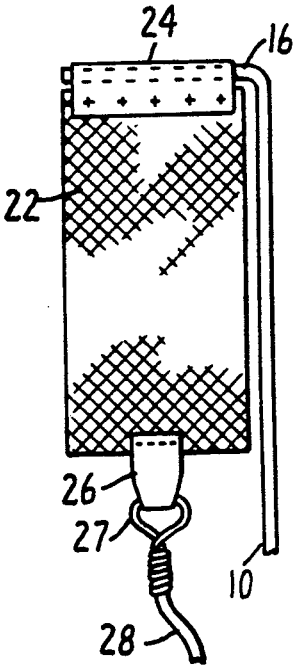
FIG. 2 is a plan view of the gripper end of the tool according to the present invention.

The gripper end 16 is perpendicular to the main section 12 and in the preferred embodiment extends for four and one half inches. As shown in FIG. 2, a gripper 20 is attached to the gripper end 16. The gripper 20 is comprised of a gripper pad 22 and cord tab 26. The gripper pad 22 is preferably made of a non-slip material, such as a piece of ultrasuede with rubber silicon ribs adhered thereto. A suitable alternative can be made from a mesh of polyester thread and rubber silicon, such as may be found on commercial fishermen's gloves. The gripper pad 22 is folded over the gripper end 16 and affixed to itself by a strong adhesive, such as Barg cement, or shoemaker's glue. The cord tab 26 is a piece of ultrasuede affixed to the bottom of the gripper pad 22 by adhesive as described above. The cord tab 26 has a loop 27 for attaching a cord 28. The cord 28 has a length which is approximately one hundred and fifty percent of L.

Figure 3A:
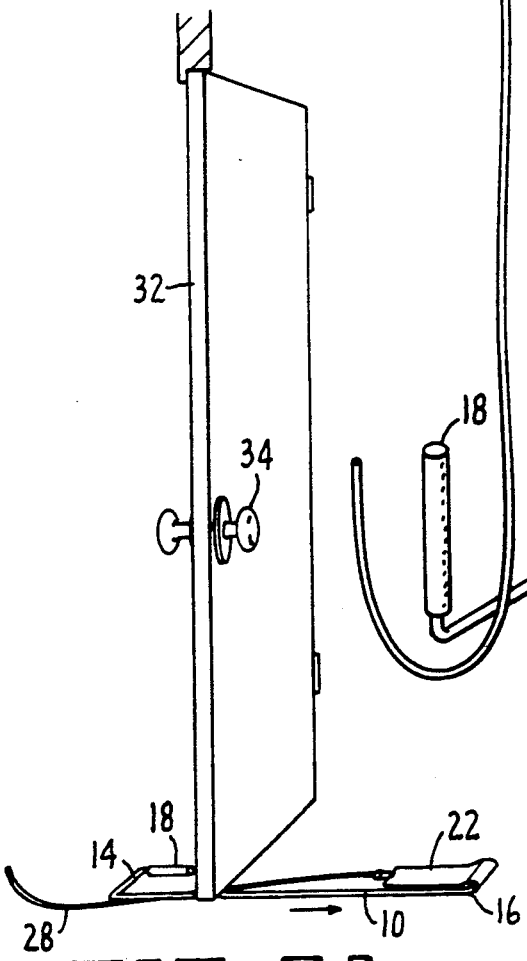
FIGS. 3*a* and 3*b* are schematic diagrams to illustrate the use of the tool on a common door.
Figure 3B:
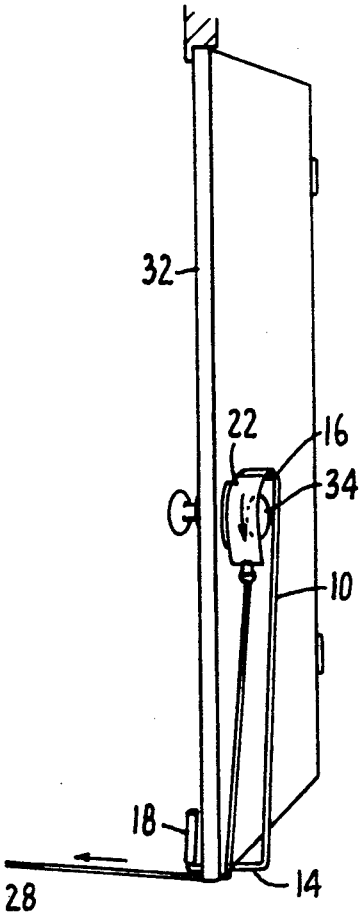

Referring now to FIGS. 3*a* and 3*b*, the gripper end 16 of rod 10 is inserted into the narrow space between the floor 30 and the bottom of the door 32, being careful to retain the end of cord 28 on the user side of the door 32. For tight thresholds, a standard 8.5 by 11 inch plastic file holder over the gripper 20 works well to assist the user in slipping the tool underneath the door. Once the full length L of rod 10 has been inserted under the door 32, the handle 18 is manipulated to rotate the rod 10 to an upright position in correspondence with the doorknob 34. By a combination of sense of feel and approximating the height of the knob 34, the rod is rotated to place the gripper pad 22 on the doorknob 34. The handle 18 and cord 28 are then manipulated in combination such that the gripper pad 22 turns the doorknob 34 and opens the door 32. More specifically, by turning the handle 18 in a clockwise direction (as viewed by the user), and simultaneously pulling the cord 28, the knob 34 is gripped and caused to turn in a clockwise direction (as viewed from inside the door).

Figure 4:
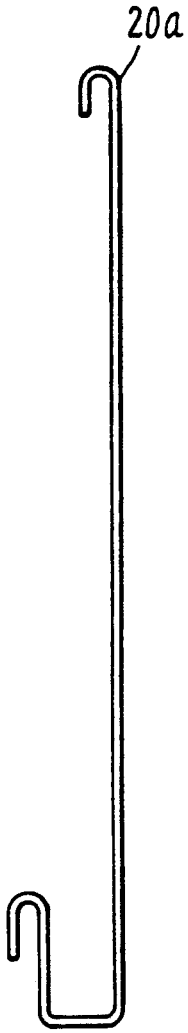
FIG. 4 is a plan view of an alternative embodiment of the tool of the present invention.

An alternative embodiment is shown in FIG. 4. Top end 20*a* is bent in a 180 degree U-shape. For doors having handles rather than knobs, the tool is operated in similar fashion to hook the handle and pull it down, thus opening the door. No gripper pad is required, and the rotating action of the rod 10 acts as a simple lever action to urge the handle downward.

Figure 5:
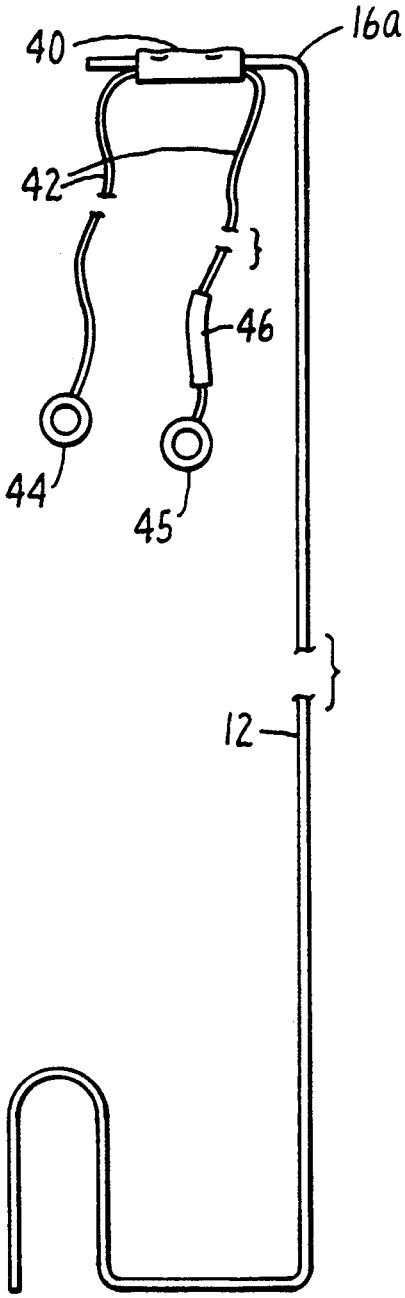
FIG. 5 is a plan view of a third embodiment of the tool according to the present invention.
Figure 6:
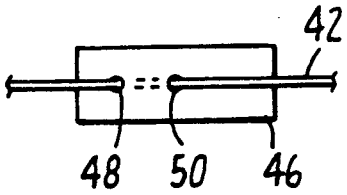
FIG. 6 is a plan view of the cord portion of the tool according to the present invention.
Figure 7:
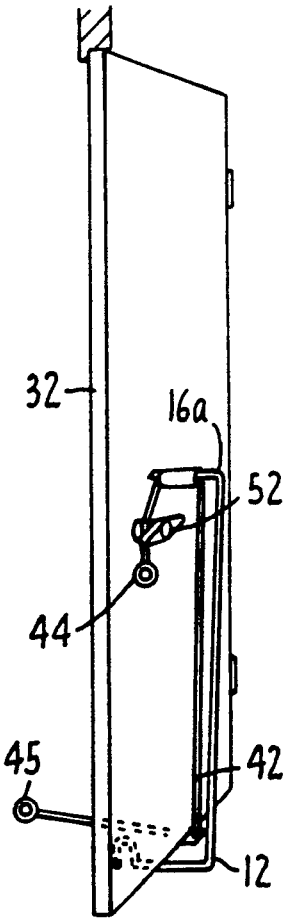
FIG. 7 is a schematic diagram illustrating use of the tool of FIG. 5 on a common door.

A third embodiment is shown in FIG. 5. The gripper end 16*a* is straight as in the first embodiment, but a length of metal tubing 40 is disposed distally from the main section 12 of rod 10. A cord 42 is passed through the tube 40 and the tube is crimped onto the gripper end 16*a* of rod 10. The cord 42 has a length which is approximately one hundred fifty percent of L. At each end of cord 42 are a pair of loops 44 and 45, preferably made from one-eighth inch plastic tubing. A one-sixteenth inch lexan sheet 46 may be used near loop 45 in order to simplify operation of the cord 42. See FIG. 6. An eyelet 48 is located one inch from one end of the lexan sheet 46, and a second eyelet 50 is located approximately three inches from the same end of the sheet 46. The cord 42 is inserted through the eyelets 48, 50 as shown. In this way, the lexan sheet 46 may be positioned underneath the door 32 such that the cord does not rub against the door and bind or wear while the tool is in use. Referring now to FIG. 7, it can be seen that by manipulating the rod 10, the end of cord 42 having loop 44 is placed between the door 32 and the operating hardware of the deadbolt 52, as shown in FIG. 7. Then by pulling on loop 45 of cord 42, loop 44 is pulled upward and urged against the deadbolt, the upward pressure being sufficient to turn the deadbolt 52 in a counterclockwise direction (as viewed from inside the door).

Figure 8A:
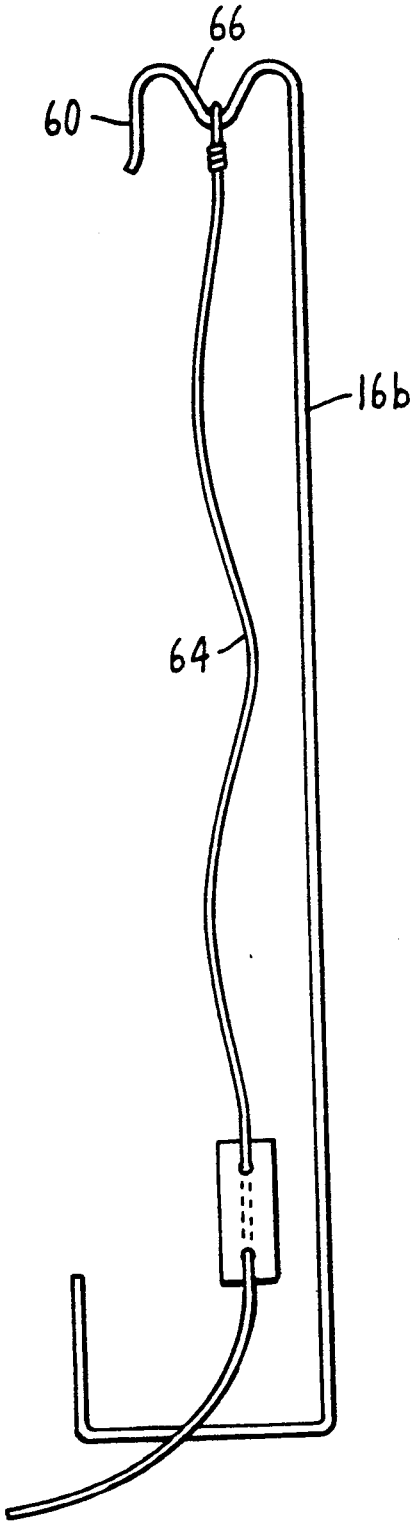
FIG. 8*a* is a plan view of a fourth embodiment of the tool according to the present invention.
Figure 8B:
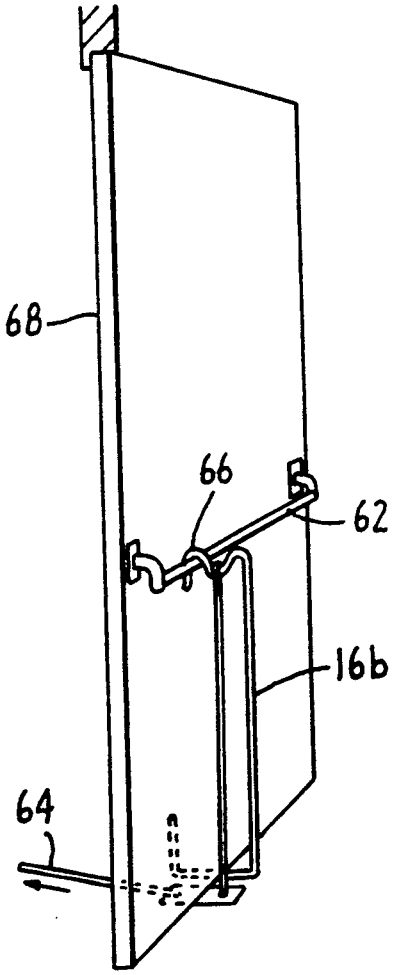
FIG. 8*b* is a schematic diagram illustrating use of the tool of FIG. 8*a* on a common exit door.

A fourth embodiment, shown in FIGS. 8*a* and 8*b*, may be used on exit doors of the type having a horizontal bar across the door which must be pushed down to open the door. Here, the gripper end 16*b* is curved as shown, such that end 60 is adapted to easily fit over the top of the cross-bar 62. Cord 64 is attached at point 66. The tool is slipped under door 68 and maneuvered to enable end 60 to fit over the top of cross-bar 62. Cord 64 is then pulled, forcing cross-bar 62 down and opening the door 68.

I claim:

1. An apparatus for manipulating the opening mechanism of a locked door, comprising:

a. an elongated rod adapted to be inserted into the narrow space between the floor and the bottom of the locked door, said elongated rod having a main section, a handle end and a gripping end, wherein the main section has a length L selected to correspond to the vertical distance between the door opening mechanism and the floor, and wherein the handle end and the gripping end extend away from the main section in the same direction such that the handle end, the main section, and the gripping end define a plane;

b. a handle for manipulating and rotating the elongated rod while it is positioned in the space between the floor and door bottom, said handle disposed at the handle end of the elongated rod;

c. a gripper adapted for engagement with the opening mechanism, said gripper disposed at the gripping end of the elongated rod; and d. a cord attached to the gripper, said cord having a length which is approximately one hundred fifty percent of the length of said main section, wherein said gripper and elongated rod are inserted into the narrow space between the floor and door bottom and said handle is used to rotate said elongated rod and gripper to engage said door opening mechanism, and wherein the cord is pulled to urge said door opening mechanism in a downward direction thereby causing said door opening mechanism to open said door.

2. The apparatus of claim 1, wherein the gripper comprises a flexible pad attached to the gripping end of the elongated rod.

3. The apparatus of claim 1, wherein the gripper comprises an M-shaped portion of the elongated rod, and wherein the cord is coupled to the gripper at the middle of the M-shaped portion.

4. An apparatus for manipulating the inside doorknob of a locked door, comprising:

a. an elongated rod adapted to be inserted into the narrow space between the floor and the bottom of the locked door, said elongated rod having a handle end and a gripping end, wherein the rod has a length L selected to correspond to the vertical distance between the doorknob and the floor;

b. a handle for manipulating and rotating the elongated rod while it is positioned in the space between the floor and door bottom, said handle disposed at the handle end of the elongated rod;

c. a gripper adapted for engagement with the doorknob, said gripper comprising: (i) a short rigid member disposed at the gripping end of the elongated rod substantially perpendicular to the rod longitudinal axis; (ii) a flexible gripper pad affixed at one edge to said short rigid member; and (iii) cord coupling means attached to said gripper pad at the edge opposite said short rigid member; and d. a cord, attached at one end to said cord coupling means, said cord having a length approximately one hundred fifty percent of said elongated rod, wherein said gripper and elongated rod are inserted into the narrow space between the floor and door bottom, said handle is used to rotate said elongated rod and gripper from a substantially horizontal position to a substantially vertical position to thereby engage said doorknob, and wherein the combined manipulation of the gripper by said handle and said cord causes said doorknob to turn and to open the locked door.

5. The device of claim 4, wherein the gripper pad is made from non-slip material such as a mesh of polyester thread and rubber silicon.

6. The device of claim 4, wherein the gripper pad comprises a piece of ultrasuede with rubber silicon ribbing thereon.

7. A method for manipulating the doorknob of a locked door, comprising:

a. providing an apparatus which comprises:

(i) an elongated rod adapted to be inserted into the narrow space between the floor and the bottom of the locked door, said elongated rod having a handle end and a gripping end, wherein the rod has a length L selected to correspond to the vertical distance between the doorknob and the floor;

(ii) a handle for manipulating and rotating the elongated rod while it is positioned in the space between the floor and the door bottom, said handle disposed at the handle end of the elongated rod;

(iii) a gripper adapted for engagement with the doorknob, said gripper comprising (1) a short rigid member, disposed at the gripping end of the elongated rod and substantially perpendicular to the rod longitudinal axis; (2) a flexible gripper pad affixed at one edge to said short rigid member; and (3) cord coupling means attached to said gripper pad at the edge opposite said short rigid member; and (iv) a cord, attached at one end to said cord coupling means, said cord having a length at least one hundred fifty percent of said elongated rod, (b) inserting the apparatus into the narrow space between the floor and the bottom of the door;

(c) rotating the apparatus such that the gripper end engages the doorknob; and (d) manipulating in combination the handle end and the cord of the apparatus to turn the doorknob and opening the door.

8. An apparatus for manipulating the inside door handle of a locked door, comprising:

a. a rod having a long, straight section;

b. a first short section disposed at one end of the rod; and c. a second short section having a handle disposed at the other end of the rod, wherein the first short section extends in a first direction away from the long section into a U-shape, and wherein the second short section is angled in the first direction away from the long section, and wherein the first short section of the rod is slipped under the door and maneuvered by said second section handle to engage the door handle, and wherein the rod is then maneuvered at an angle to pull the handle down to thereby open the door.

9. An apparatus for manipulating a deadbolt on a door, comprising:

a. an elongated rod adapted to be inserted into the narrow space between the floor and the bottom of the door, said elongated rod having a main section, a handle end, and a gripping end, wherein the main section has a length L selected to correspond to the vertical distance between the doorknob and the floor, and wherein the handle end and the gripping end extend away from the main section in the same direction such that the handle end, main section, and gripping end define a plane;

b. a handle for manipulating and rotating the elongated rod, said handle disposed at the handle end of the elongated rod;

c. a hollow tube coupled to the gripping end of the elongated rod; and d. a cord inserted through the tube, said cord having a length approximately one hundred fifty percent of the length of said main section and a pair of loops, one on each end thereof, e. wherein the gripping end of said rod is inserted into the narrow space between the floor and door bottom while holding one of said loops, and wherein said handle is used to rotate said rod such that the cord is inserted between the door and the deadbolt, and wherein said cord is pulled causing the free loop to urge said deadbolt into rotation, thereby unlocking or locking said deadbolt.

* * * * *